United States Patent [19]

Moorman

[11] Patent Number: 4,946,093

[45] Date of Patent: Aug. 7, 1990

[54] HALF SLOTTED CONTAINER LID WITH SELF-LOCKING DOUBLE SIDE PANELS

[75] Inventor: Stephen E. Moorman, Bowling Green, Ohio

[73] Assignee: Nekoosa Packaging Corporation, Maumee, Ohio

[21] Appl. No.: 405,526

[22] Filed: Sep. 12, 1989

[51] Int. Cl.[5] ..... B65D 5/68

[52] U.S. Cl. ..... 229/128.19; 229/23 BT

[58] Field of Search ..... 229/23 BT, 23 R, 125.19, 229/125.26, 125.27

[56] References Cited

U.S. PATENT DOCUMENTS

| | | | |
|---|---|---|---|
| 2,021,234 | 11/1935 | Gomes | 229/125.26 |
| 2,973,127 | 2/1961 | Royce | 229/125.19 |
| 3,157,345 | 11/1964 | George | 229/23 BT |
| 3,907,194 | 9/1975 | Davenport et al. | 229/125.19 |
| 4,474,324 | 10/1984 | Forbes, Jr. | 229/23 BT |
| 4,580,718 | 4/1986 | Muise | 229/125.26 |

FOREIGN PATENT DOCUMENTS

| | | | |
|---|---|---|---|
| 2383838 | 11/1978 | France | 229/23 BT |

*Primary Examiner*—Gary E. Elkins
*Attorney, Agent, or Firm*—John R. Nelson

[57] ABSTRACT

There is disclosed a half-slotted container body and lid, each made from a blank of corrugated paperboard. The lid blank has an additional score to provide a fold-line around the perimeter of the side and end panels at approximately one-half of the depth. This score line defines inner and outer panels of the lid's perimeter side and end walls. Where this fold-line intersects each of the panel score lines defining the ends of the side and end panels, there are two diagonal scores which radiate from that point in opposite directions extending to the free edge of the inner panels.

When the lid is set up, the top flaps are folded inwardly and secured to form a top of the lid, and the inner panels are folded inwardly hinged at the four corners by the diagonal scores. The inner panels are pushed in at the interior four corners of the lid locking the inner panels along the outer panels to provide a two-ply perimeter wall of the lid. The resulting inward bulge of the inner panels of the lid create a secure lock of the lid on the body and provide support for the sides of the body against outwardly bulging under load.

The continuous two-ply construction of the sides of the lid provide channeling space between adjoining containers in a stacked pallet load to enhance uniform air flow and cooling of produce, such as bananas and fruits, packed in the containers.

16 Claims, 5 Drawing Sheets

HALF SLOTTED CONTAINER LID WITH SELF-LOCKING DOUBLE SIDE PANELS

The present invention relates to corrugated containers which are used in handling, processing and shipment of fruit, such as bananas.

BACKGROUND OF THE INVENTION

Bananas, as well as certain other fruits, are processed for ripening by flow of air and gas through the containers in which they are packaged and stacked for permitting the channeling of the gas. By establishing channels in container storage of the fruit, the circulation of gas or air or both through the load enhances a consistency in ripening the fruit. Respirating fruits (including tomatoes) have their ripening controlled by way of controlled atmospheres.

The storage, handling and the like of fruits has been carried out in containers or cartons made of corrugated paper materials, herein referred to as corrugated paperboard or corrugated paper.

Cartons most employed at present require a die cut machine to form multi-panel score lines in a blank to make a corrugated design of carton referred to in the industry as a die cut tray. There are other designs in use which require a stitch in the panels to maintain infolded panels of the tray in a set-up condition.

Another form of container usable for the handing, storage, etc. of fruit is a half-slotted container (HSC). Such a carton includes a lid and base of approximately equal depth, and the lid telescopically fits over the base to complete the container.

Other containers used for the purpose of handling and processing fruit are two-piece telescopic containers consisting of a full height base and a telescopically fitting top or base that is substantially the height of the base. The base and lid are provided with vent apertures, slots or the like to enable circulation of gas and air through the fruit. The double thickness of the walls of the lid and base assembled provide lateral strength and support for the container to minimize side bulging and to improve side wall support in the stacking of the containers in loads or stacks used to process and to store loads of the filled container.

SUMMARY OF THE INVENTION

The present invention provides a half-slotted container and lid with double corrugated board thickness around the perimeter of the box to enhance the equal distance spacing between boxes in stacking them for uniform air or gas flow and cooling of the produce in the boxes. The lid structure is made from a blank that is scored longitudinally and approximately centrally of the side panels. The blank is die cut and when assembled as a lid has included diagonal score lines that radiate outwardly from each of the four corners. The extremities of the panels are folded inwardly along the scoreline of each side panel and the diagonally scored corners provide a gusset-type corner that self-lock the inwardly folded inner portions in place.

The box is capable of manufacture by standard box marking equipment and set-up equipment for economy of manufacture.

The container of the present invention employs the HSC basic half-slot container as a lid with an additional score line extending around the perimeter of the body of panels and positioned approximately at the halfway portion in the depth direction. Where the score intersects with the transverse panel scores as at the four corners, two diagonal scores radiate at 45 degrees outwardly from that intersection extending to the free edge. Upon set-up, the outer side panels are folded inwardly and downwardly toward the top of lid allowed by the diagonal scores at the corners. The inner side panels are pushed inwardly at each of the four corners of the lid locking the panels in place such that the sides of the lid are two adjacent plies or panels of corrugated.

The invention provides added stability and resistance against bulging of the sides of the body of the container by virtue of the side panels of the lid telescopically laid over the body sides. The tendency of the sides of the container body to bulge outwardly when loaded with produce and the inherent bulge of the side panels of the HSC lid provide a secure lock of the lid to the container.

When the filled containers with lids in place are stacked in unit load or pallet load configuration, the double thickness of the corrugated in the perimeter of the lid create additional space for the air flow between boxes in the pallet stack which is beneficial to the uniformity of ripening of the fruit, such as bananas. The extra support of the double ply perimeter of the HSC lid of this invention gives increased side and end support against bulging.

The channels or tunnels created by the boxes of the present invention aid the consistency of ripening of the packaged fruit in instances where ripening is controlled by controlled gaseous atmospheres.

DESCRIPTION OF THE PREFERRED EMBODIMENT

Figure 1:
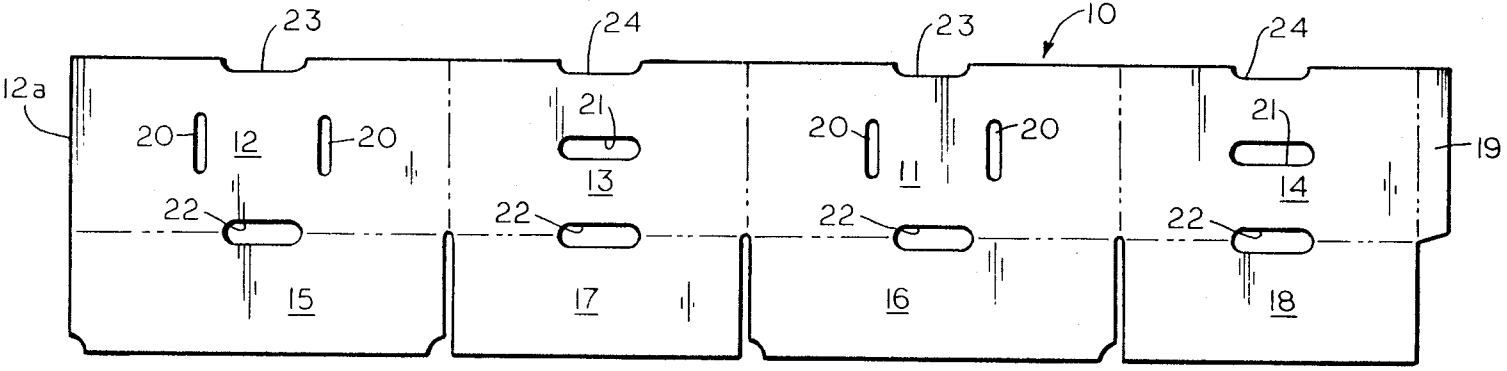
FIG. 1 is a plan view of the blank for a half-slotted container body which is the bottom of the container.

Referring to the drawings, and specifically to FIG. 1, a lower box is erected from a die cut blank 10 of corrugated paperboard, or like paper product. Blank 10 is a HSC (half-slotted container) blank which includes two side panels 11 and 12 hingedly connected to two end panels 13 and 14. Bottom side flaps 15 and 16 are hingedly connected along longitudinal score lines to side panels 11 and 12, respectively, and bottom end flaps 17 and 18 are connected similarly to the end panels 13 and 14. The bottom flaps 15–18 are of the same width which is equal to one-half the length of end panels 13 and 14 or less. The flaps are separated by slots between them which extend the width dimension of the flaps to the fold-line hinge for the flaps on the panels 10–13. End panel 14 includes a tab 19 extending along the outer edge of the end panel. When the panels are folded along their respective fold-lines to form a rectangular shape, tab 19 is attached by adhesive, staples or other suitable means to the inside surface of the side panel 12 adjacent its free edge 12*a*.

For assembly of the bottom of the container, the bottom side flaps 15 and 16 are folded upwardly and inwardly. Next, the bottom end flaps 17 and 18 are folded upwardly and to lie in surface contact with the side flaps. The bottom flaps are fastened together by adhesive or staples to form an open-topped box 10*a* as shown on FIGS. 3 and 4. The opposite outer corners of the side flaps 15 and 16 have circular cut outs of a radius that enables the flaps when folded inwardly to form the bottom wall of the box to conform to the bottom end openings 22 of the box (See FIG. 3).

The side panels 11 and 12 each are provided with plural elongated openings 20 punched from the material which allow air flow into the box and across the box. The end panels 13 and 14 are each provided with a larger elongated opening 21 which allow air flow into the box and lengthwise of it and also provide hand holes at the end of the box for lifting. Each of the bottom flaps and side wall panels of the blank 10 have an elongated opening 22 formed centrally and along the fold-line such that the fold bisects each opening 22. Along the longitudinal edge of blank 10 opposite the bottom flaps are die cut segments or cut-out areas 23 and 24 which are centered, respectively, on the longitudinal outer edge of the panels 11 and 12 and panels 13 and 14. These cut-outs 23 and 24 are each of the same longitudinal dimension as the die cut openings 22. The cut-outs 23 and 24 cooperate with die cut openings in the lid (to be described later) forming air flow passages along the top of the container.

Figure 2:
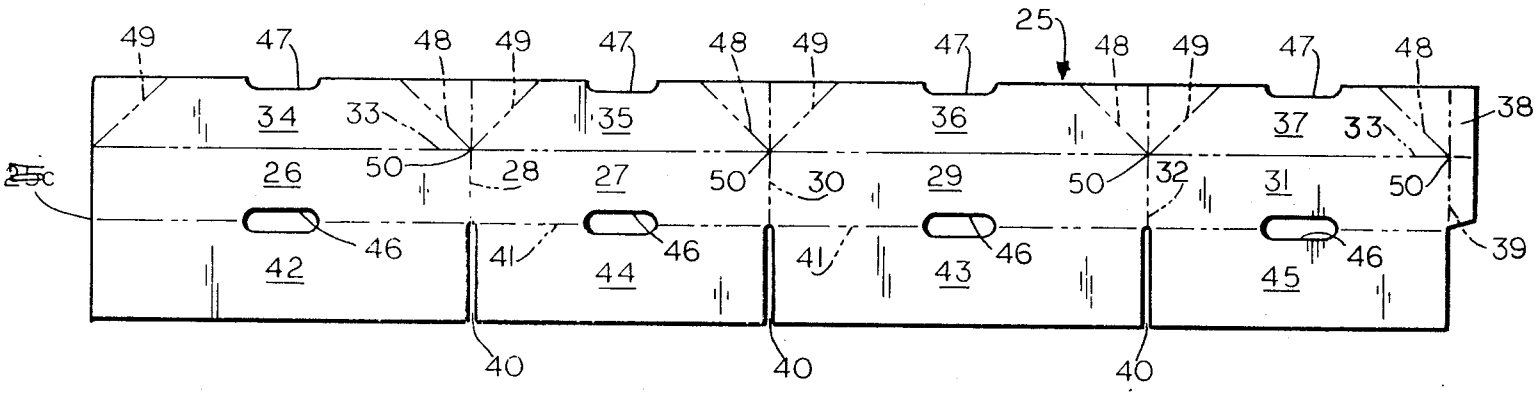
FIG. 2 is a plan view of the blank for the top or lid of the container which incorporates the present invention.
Figure 6:
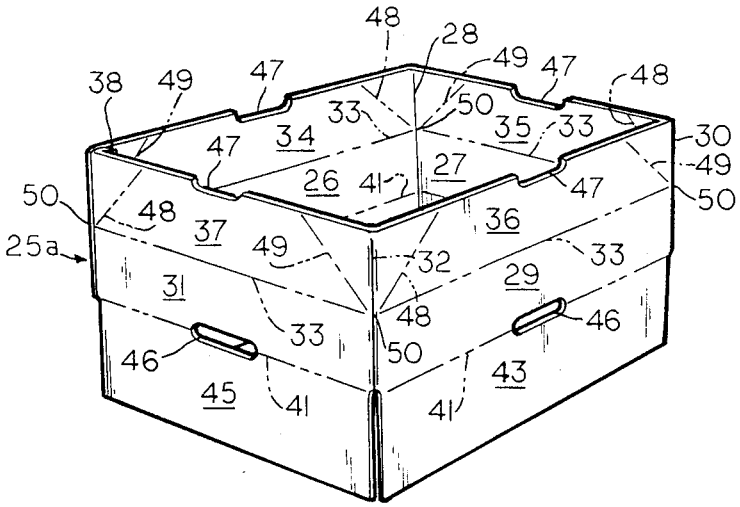
FIG. 6 is a perspective view of the lid blank showing further stage of assembly in which the manufacture's joint is fastened.
Figure 7:
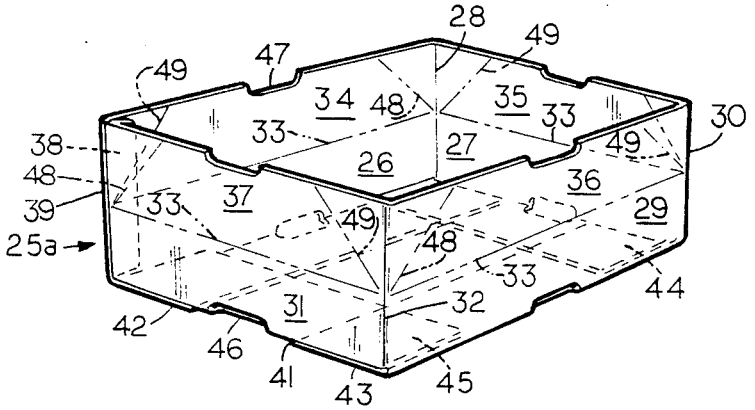
FIGS. 7–9 are perspective views of the lid showing the panels folded closed at one end and the panels of the other end being folded inwardly to lock the outer panels in place.
Figure 8:
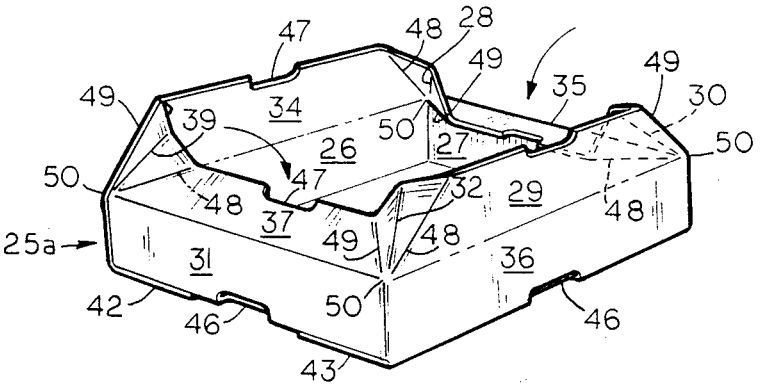
Figure 9:
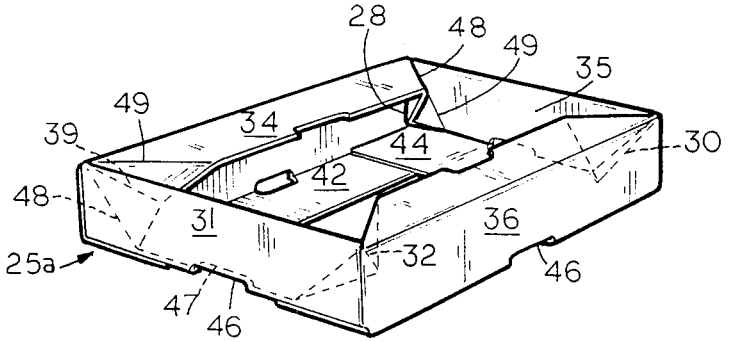
Figure 10:
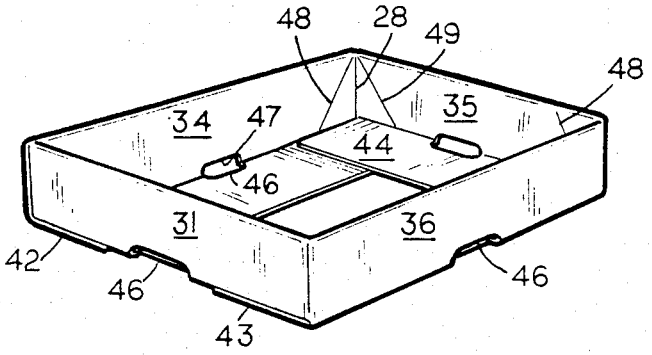
FIG. 10 is a perspective view of the lid in assembled condition ready for use with the bottom box as shown on FIGS. 3 and 4.

Referring to FIG. 2 of the drawings, the half-slotted container lid of the invention is formed from a blank 25 die cut of corrugated paperboard or like material. The blank 25 has an outer side panel 26 and adjacent outer end panel 27 hinged along fold-line 28 and joined to outer side panel 29 along fold-line 30. Fold-lines 28, 30, 32 and 39 are panel fold-lines at the end of each of the inner and outer panels. The outer side panel 29 is hingedly connected to outer end panel 31 along fold-line 32. Inner panels are connected to the outer panels 26, 27, 29 and 31 along a longitudinal fold-line 33 extending the length of all of the panels, which provides a perimeter fold-line for the lid wall. The inner side panel 34 is hinged to outer end panel 26, and inner end panel 35 hinged to outer end panel 27. The inner side panel 36 is hinged to outer side panel 29 and inner end panel 37 hinged to outer end panel 31. A tab 38 is joined to the end panels 31 and 37 along a lateral fold-line 39 and tab 38 provides a manufacturer's joint for assembling lid blank 25 to a rectangular shape. Upon folding the blank at the fold-line 30, and tab 38 thereof at fold-line 39, tab 38 is secured by adhesive or other means along the free transverse edge 25*c* of panels 34 and 26 to a flattened shape. As shown on FIG. 6, this is squared to a rectangular shape hinged at the corners by the respective fold-lines 28, 30 and 32.

Blank 25 includes flaps which are separated by slots 40 extending from the free edge of the blank transversely to the longitudinal fold-line 41 extending around the perimeter of the lid and which is parallel to the perimeter fold-line 33. The side flaps 42 and 43 lie adjacent the end flaps 44 and 45. The flaps 42–45 are folded inwardly to form the top of the lid. Each of the flaps 42–45 and outer panels 26–31 have die cut oval-shaped elongated openings 46, each of which are centered longitudinally of the respective flaps and panels and the fold-line 41 bisects the several openings 46. Additionally, there are cut-out areas 47 disposed along the longitudinal free edge of the blank, one centered on each of the inner panels 34–37. Cut-outs 47 correspond to half of the openings 46 and are positioned to register with the opening 46 upon folding the inner panels inwardly along the perimeter fold-line 33. Preferably, the width of the panels 34–37 equal the width of the panels 26–31. At opposite ends of each of the inner panels 34–37, there are scores defining diagonal fold-lines 48 and 49. The diagonal fold-lines on each such panel radiate from the intersection 50 of the perimeter fold-line 33 with a panel fold-line (28, 30, 32 and 39) defining the ends of the panels and diagonal fold-lines 48 and 49 are angled at 45 degrees inwardly of each of the inner panels. The included angle between two adjacent diagonal score lines 48 and 49, for example between flaps 34 and 35, is 90 degrees. The panel fold-line, e.g. line 28, bisects this included angle.

More specifically, each juncture between the inner panels 34, 35, 36 and 37 of the blank 25 provides a gusset-style corner that is defined by two diagonal lines 48 and 49 radiating in opposite directions from the juncture 50 of the longitudinal fold-line 33 (hinge) and the transverse fold-line (hinge) for the panel, indicated as fold-lines 28, 30, 32 and 39. This is illustrated on FIG. 6 on the blank shown joined to a rectangle form 25*a* in constructing the lid.

Referring to FIGS. 5–10, the blank 25 is formed to a rectangular shape by fastening the tab 38 at the one end of the blank 25 to the (inner and outer) panels 34, 26 adjacent the other free end 25*c* of the blank. As the blank is closed and fastened, it assumes the shape shown on FIG. 6. In actual practice, the lid is assembled in a collapsed condition about diagonally opposite lateral fold-lines, such as 28, 32 or 30, 39, to a flat form for shipping or storage of the container lid before use.

The HSC bottom of the container is made up in similar fashion by fastening the tab 19 to the end of side panel 12 adjacent its free end 12*a*. In handling and storage before use, this assembled blank 10 is in flattened form, erected by folding at diagonally opposite transverse fold-lines and securing the bottom flaps to secure the bottom of the box.

Figure 3:
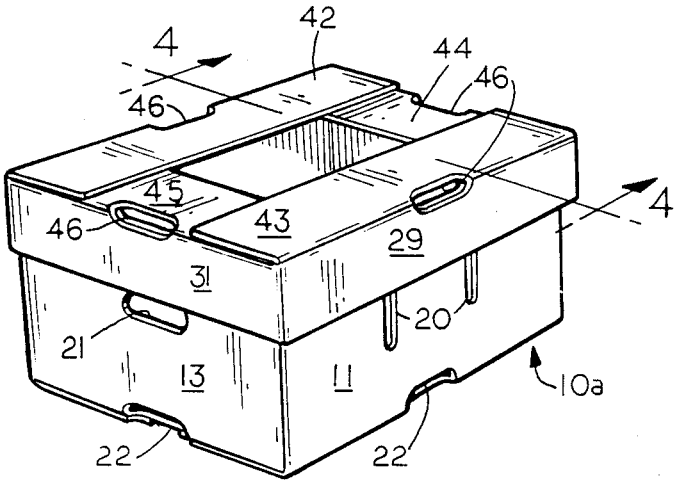
FIG. 3 is a three-quarter perspective view of the assembled HSC container of the invention.
Figure 4:
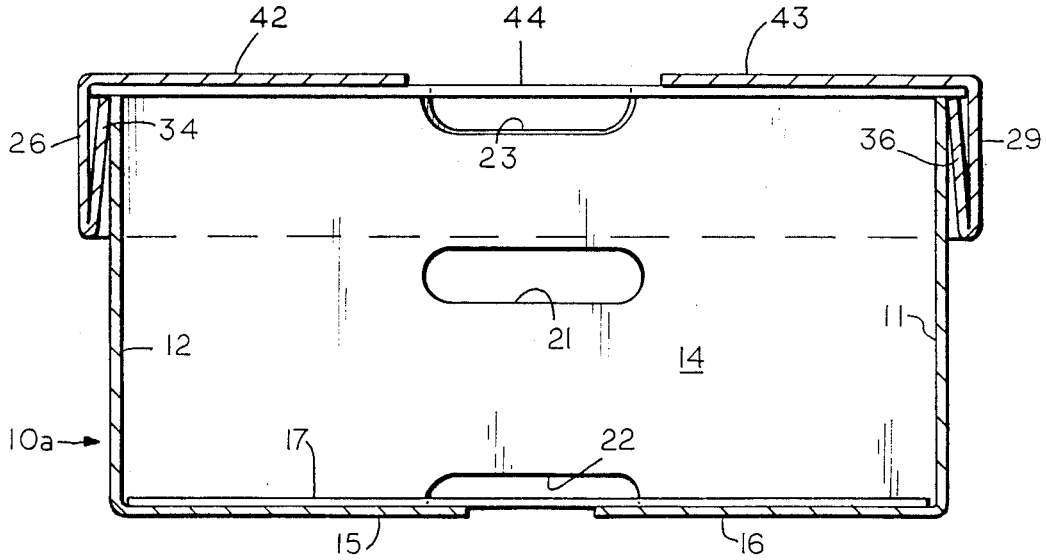
FIG. 4 is a sectional elevational view taken along line 4—4 on FIG. 3.
Figure 5:
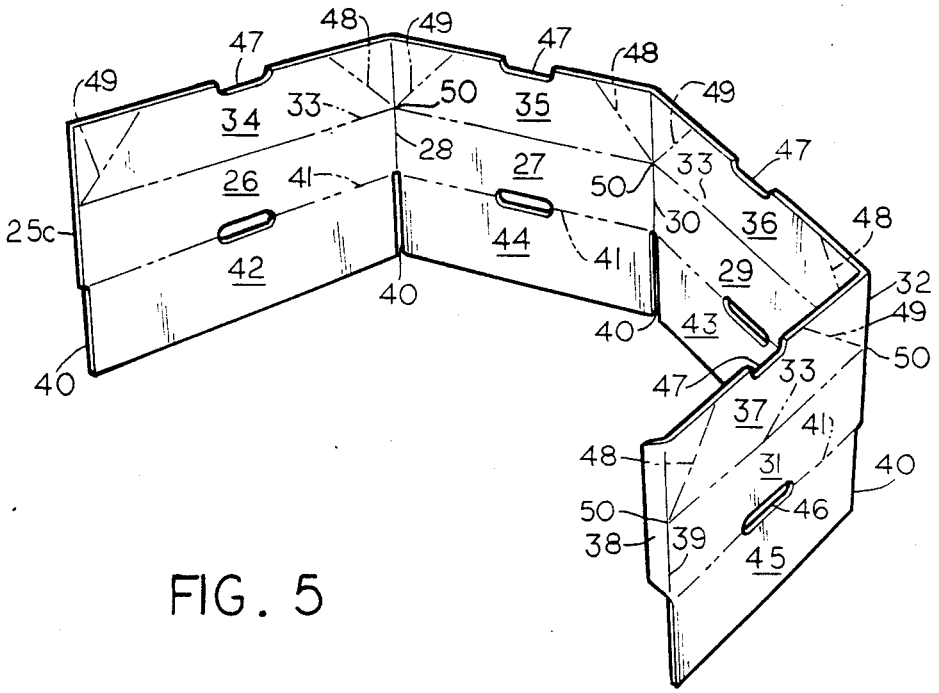
FIG. 5 is a perspective view of the blank shown on FIG. 2 illustrating the assembly of the lid.

At the point of use, the bottom box is made up as shown on FIGS. 3 and 4 by folding the bottom side flaps 15 and 16 inwardly, then folding the end flaps 17 and 18 over them. The bottom flaps 15–18 are secured to each other, such as by staples or adhesive, to form a full height bottom portion of the container. The flaps 15–16, when folded, do not meet but are spaced apart, as shown on FIG. 4, and similarly the flaps 17–18 do not meet but are spaced from each other. This provides a centralized opening in the bottom wall of the box 10*a* for the flow of air. As may be optionally utilized in this style of box, an internal partition (not shown) may be fastened in place to separate the contents and provide compartments. Such practice has been employed for handling of fruit and produce. The lower box portion 10a of the container also includes the bottom edge apertures 22 extending through the fold-line for the flaps 15–18 and the apertures 22 provide for added flow of air through the bottom wall and lower side wall of the container as well as through the aforementioned bottom opening near the center of the bottom wall.

The lid is assembled as shown on FIGS. 7–10. The first stage of assembly includes folding the flaps 42–43 inwardly and flaps 44–45 are folded to overlie them. These flaps are fastened together by adhesive or staples to make up the top wall of the lid 25a. The end flaps 44–45 do not touch when folded inwardly to make up the top wall and the side flaps 42–43 do not meet or touch so that a centralized opening is provided in the top of the lid 25a. This opening is best seen on FIGS. 3 and 4.

After the top wall is assembled, the inner end panels 34 and 37 are folded inwardly followed by inner side panels 35 and 36. The diagonal fold-lines 48 and 49 of the gusset-style corners readily permit this folding of the inner flaps inwardly. The four inner panels are joined together as one continuous wall or band of corrugated. Upon setting up the lid, the gusset-style corners permit infolding the panels. The fold-lines 28, 30, 32 and 39 between panels 34–37 extend innermost and near the interior corners of the lid. These fold lines lock the corners in place, and the diagonal fold lines 48 and 49 on either side provide hinges in the inner panels at their ends. The inner panels 34–37 are slightly bowed inwardly by virtue of their dimensions and in use provide a tight, spring-like fit of the perimeter wall of the lid on the lower box (see FIG. 4, for example).

As is seen on the finished container, the sides and ends of the lid are each of 2-ply corrugated around the perimeter of the lid, and the spring effect of the wall of the inner panels provide a snug, tight fit of the lid on the box. In the preferred example of the disclosed embodiment, the sides and ends of the lid perimeter extend down over approximately one half the vertical height of the side and end walls of box 10a. This allows for enhanced channeling of air between containers in the pallet formation of containers. It also conserves corrugated material and is most cost effective.

Figure 11:
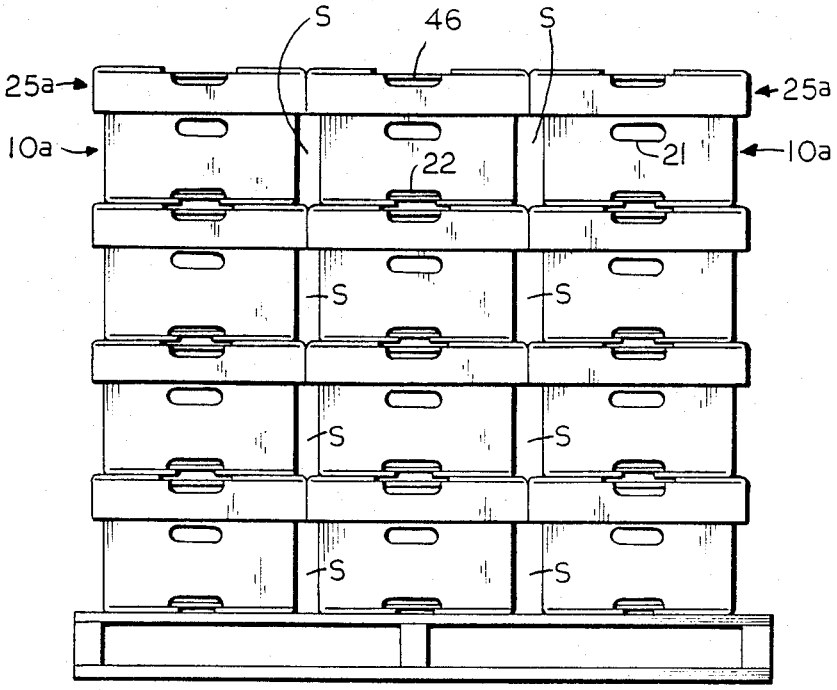
FIG. 11 is an end view showing a pallet load of the containers of the invention in use.

The 2-ply perimeter of the lid creates additional space for flow of air or gas when the filled containers are placed in a pallet load and processed. This space is illustrated on FIG. 11 and provides "channeling" of air flow between the boxes longitudinally and transversely of the pallet load. A typical pallet load is shown on FIG. 11 in which each layer is six containers placed 2×3, i.e. two deep and three wide. The channeling space S runs longitudinally of the three boxes as well as laterally of the two boxes. The pallet load is typically eight tiers in height, however, for ease of illustration but four layers of the pallet load is shown on FIG. 11 to illustrate the "channeling".

In addition to channeling effect, the containers of this invention provide enhanced support through the 2-ply perimeter side walls of the lid which support the ends and especially the sides of the container against bulging outwardly. Further, the inherent bowing inwardly of the inner panels of the lid toward the center of the box providing a secure package for the produce.

The box and lid described are readily manufactured by standard boxmaking equipment and employing die cut and scoring elements. The placement of the vent openings and apertures of the preferred embodiment of the invention herein provide maximum strength of the container by the placement of the aperture in relation to the direction of the corrugations in the corrugated paperboard.

It should be noticed that in the present invention, except for the manufactures tab and joint, there are no other tabs or the like which are glued or stapled in the make-up of the 2-ply perimeter wall of the lid in contrast with prior designs wherein all four corners are fastened or stapled to form the perimeter of the side wall of the lid.

In view of the disclosure, further modifications of the invention will be apparent to those skilled in the art, and it is intended that the scope of the invention be determined by the appended claims.

I claim:

1. A blank for forming a container lid comprising alternating side and end flaps hinged along one of their sides at a first longitudinal fold-line, said flaps being separated from each other from said fold-line to one longitudinal edge of the blank, a second longitudinal fold line parallel with the first, lateral fold-lines extending from the first longitudinal fold-line to the other longitudinal edge of the blank, said lateral fold-lines defining alternating side and end panels and a tab, said tab being disposed at the end of the blank providing a manufactures joint for fastening the blank into a closed perimeter of the lid, said second longitudinal fold-line forming side-by-side inner and outer panels disposed lengthwise along one side of the blank, two diagonal fold lines provided by scores in the blank extending from the intersection of each lateral fold-line and the second longitudinal fold line to the adjacent other longitudinal edge of the blank, said two diagonal fold-lines having an included angle of 90 degrees and each extending 45 degrees from said second longitudinal fold line, said diagonal fold lines, together with the lateral fold-line adapted to provide a gusset-style corner for the lid upon folding the inner panels inwardly about said second longitudinal fold-line.

2. The container lid blank of claim 1 in which a plurality of aperatures are fomed along the first longitudinal fold line, each said aperatures extending into the adjacent flaps and into said outer panels.

3. The container lid blank of claim 2 in which said plural apertures comprise and aperature located at each of said flaps.

4. The container lid blank of claim 3 in which each of said aperatures are centered on the first longitudinal fold line, and the inner panels and outer panels are substantially equal in width, the inner panels having cut out portions along the edge of the blank located to register with said aperatures upon folding the inner flaps along said second longitudinal fold line.

5. The container lid blank of claim 4 in which said aperatures are elongated, oval shaped die cut aperatures bisected by said first longitudinal fold line and cut out portions along the edge of the blank are substantially equal to half said oval shaped aperatures.

6. A lid for a container comprising a top wall, a pair of spaced side walls and a pair of spaced end walls, said side and end walls being in adjacent relationship, each said side and end walls being formed from inner and outer panels joined to each other at their sides along a longitudinal fold line, and joined to each other at their ends at a lateral fold-line to define the corner of said lid, each of the inner panels having a diagonal fold-line extending interiorly of the panel and intersecting said lateral fold-line, the diagonal fold-lines between adjacent inner panels having an included angle of 90 degrees.

said inner panels being connected continuously and folded inwardly about said longitudinal fold-line to form a two-ply perimeter wall of said lid, the diagonal fold-lines and lateral fold-line at the ends of the inner panels providing a hinged joint for locking said inner panels in place such that the inner panels bow inwardly toward the center of the lid.

7. The container lid of claim 6 in combination with a box having opposite side and end walls and a bottom wall, the box being open at the top and the lid closing the top of the box, the inner panels of the lid engaging the side and end walls of the box to provide a snug fit over the walls of the box and firmly support the walls of the box against bulging.

8. The combination of claim 7 in which the panels of the lid extend over the side and end walls fo the box for a part of their vertical height when said box is closed.

9. The combination of claim 8 in which said panels of the lid extend approximately one half the vertical height of the side and end walls of the box.

10. The combination of claim 9 in which the side and end walls of said box each have aperatures for flow of air through the box and the panels of the perimeter wall of said lid are die cut to provide aperatures at the sides and ends of the perimeter wall of the lid.

11. The combination of claim 7 including a plurality of said boxes each closed by a lid are disposed adjacent each other, the two-ply perimeter wall of adjacent lids providing a channel for air flow between boxes that are in adjoining relationship.

12. A corrugated paper container for packing produce comprising an open-topped box comprised of bottom, side and end walls, a lid for said box having a top wall and integral perimeter comprised of side and end walls depending therefrom to fit telescopically over the open end of said box, said side and end walls of the lid being two-ply comprised of inner and outer panels, the outer panels being hingedly connected to the top wall and the inner panels being hingedly connected to the outer panels at a perimeter fold-line, said inner panels being folded inwardly about said perimeter fold-line, each of the inner panels having a hinged connection to the adjacent panel at a panel fold-line, the panel fold-line forming the inner corner of the lid perimeter wall, scored diagonal fold-lines radiating outwardly at the ends of each panel from the intersection of said perimeter fold-line and the panel fold-line, the included angle between said diagonal fold-lines being 90 degrees, the inwardly folded inner panels of said perimeter wall of the lid being locked at the corners by said diagonal folds and said inwardly folded panels being bowed inwardly of the lid perimeter whereby the bowed inner panels engage the side walls of the box and securely hold the lid on the box against the side walls of the box and reinforce said side walls against bulging outwardly.

13. The corrugated container of claim 12 in which the two-ply side and end walls of the lid provide a channel for air flow between containers that are disposed in adjoining relationship.

14. The corrugated container of claim 12 which includes aperatures in the bottom, side and end walls of the box for flow of air through the box and aperatures in the side and end walls of the lid for flow of air into the box through the lid, the aperatures of said lid walls being adjacent the perimeter fold line for said panels forming the top wall of the lid.

15. The corrugated container of claim 14 in which the top wall of the lid includes a central opening and the bottom wall of the box has a central opening for flow of air through the container.

16. A foldable blank of corrugated paperboard material having two sets of hingedly connected panels and plural flaps for erecting a box lid having a two-ply perimeter side wall, the plural flaps each hingedly connected to the first set of panels along a longitudinal fold-line, the second set of panels hingedly connected to said first set of panels along a second longitudinal fold-line parallel to said first longitudinal fold-line, the individual panels of said first set and of said second set being hingedly connected to each other along panel fold lines perpendicular to said longitudinal fold lines, and a pair of diagonal fold-lines in each of said panels of said second set radiating to the edge of the panel from the intersection of said second longitudinal fold-line and the panel fold-line, said diagonal lines of said pair extending at right angles to each other.

* * * * *